US006695660B1

(12) United States Patent
Ellis

(10) Patent No.: US 6,695,660 B1
(45) Date of Patent: Feb. 24, 2004

(54) MARINE INBOARD COOLING WATER CIRCULATING SYSTEM

(76) Inventor: Richard William Ellis, 14 Lombardy Dr. 17/2a, Wilmington, DE (US) 19803

( * ) Notice: Subject to any disclaimer, the term of this patent is extended or adjusted under 35 U.S.C. 154(b) by 0 days.

(21) Appl. No.: 10/209,731

(22) Filed: Aug. 1, 2002

(51) Int. Cl.[7] ..... B63H 21/38

(52) U.S. Cl. ..... 440/88.04; 440/88.04; 440/88 C

(58) Field of Search ..... 440/88 C

(56) References Cited

U.S. PATENT DOCUMENTS 3,946,694 A * 3/1976 Belsky ..... 114/183 R
4,271,874 A * 6/1981 Brady ..... 141/1
4,869,695 A * 9/1989 Sajdak, Jr. ..... 440/88 R
5,035,208 A 7/1991 Culp
5,044,430 A * 9/1991 Avrea ..... 165/104.32
5,071,377 A 12/1991 Saunders
5,137,482 A 8/1992 Hull
5,337,774 A * 8/1994 Boyd ..... 137/1
5,362,265 A 11/1994 Gervais
5,482,483 A 1/1996 Rice
5,549,494 A 8/1996 Fosmer
6,264,517 B1 7/2001 Limoli

* cited by examiner

*Primary Examiner*—Sherman Basinger

(57) ABSTRACT

A device and method that simplifies maintenance for inboard motorboats. The device and method allows an individual to safely flush the engine of a motorboat by maintaining precise pressure control and a constant supply of liquid to the engine circulating pump. More specifically, the device and method eliminate the danger of damaging the boat's engine on account of excessive or insufficient pressure at the boat's coolant water circulating pump by maintaining appropriate pressure and flow to the cooling pump of an inboard motor boat.

7 Claims, 3 Drawing Sheets

MARINE INBOARD COOLING WATER CIRCULATING SYSTEM

BACKGROUND OF THE INVENTION

1. Field of the Invention

The present invention relates to a device and method that simplifies marine maintenance required for inboard motorboats, and more particularly, the invention relates to a device and method for delivering liquid to the cooling pump of a motorboat at controlled pressure.

2. Description of the Prior Art

It is widely recognized that internal cleaning of a boat's inboard marine engine is imperative to extending the life the engine. Depending upon an individual's use of the boat, the engine may contain saltwater, sand, mud, alkalis and other debris that will corrode the engine or inhibit performance of the cooling system if they are not properly removed. Typically, a cleaning process involves forcing clean or fresh liquid through the engine to flush out the saltwater and debris. This is accomplished by introducing a stream of liquid into the sea water inlet, which is in liquid communication with the boat's internal engine. It is also understood that when an inboard boat is out of the water it is often necessary to run its engine to demonstrate it for sales or for maintenance and repair. It is further understood that insufficient or excessive cooling water pressures within an engine's cooling system may cause damage to the engine.

There are a number of different approaches to flushing fresh or clean water through an inboard motorboat engine when the boat is removed from the water. Some examples of such devices are U.S. Pat. No. 5,035,208 to Culp, U.S. Pat. No. 5,071,377 to Saunders et al., U.S. Pat. No. 5,137,482 to Hull et al., U.S. Pat. No. 5,362,265 to Gervais, U.S. Pat. No. 5,549,494 to Fosmer and U.S. Pat. No. 6,264,517 to Limoli et al.

Culp describes a "Y" valve that is attached and accessed inside the engine compartment. Flushing water is propelled through the engine by either water pressure or gravity. In such a system, the pressure forcing liquids through the engine by such means is often either insufficient or excessive.

Saunders describes a conical member having a bendable double lip for handling attachment to different hull angles, and a T-shaped water supply conduit in connection with a water hose. The device has a height adjustable ground engaging tube that supports the device against a boat's hull. Water is forced through the engine by use of a pressurized water source. Such a system has no means of controlling the pressure of water delivered to the boat's engine and may lead to excessive or insufficient pressure within the engine.

Hull describes a suction cup adapted to cover the intake port of a boat, a locking height adjustable handle that holds the suction cup against the port, and a conduit providing fluid connection between a water hose and the suction cup. Water is forced through the engine by use of a pressurized liquid source. Like the Saunders and Culp devices, pressure within the engine may reach excessive levels or be unsufficient.

Fosmer describes a device that holds a pressurized water source to a boat's cooling water inlet in water tight contact. Like Saunders, Culp and Hull, pressure levels are not kept under control with such a system.

Gervais describes a conduit between a boat engine and a fluid supply. Cleansing fluid is supplied by a pressurized liquid source. A valve in the device controls the flow of liquid through the engine. A manual switch assembly of the device controls the valve and the starting of the boat's engine. While such a device includes a pressure lowering means, the system is complex and is subject to human error.

Limoli et al. describe a method of providing a fluid source that employs an automatic pressure relief valve. While possibly eliminating some potential damage caused by excessive pressure, the system described in Limoli does not control the liquid pressure delivered to the circulating pump and cannot simulate the pressure at the circulating pump when the boat in the water. The method and system in Limoli also does not prevent the possibility of insufficient liquid pressure at the intake of the circulating pump and the severe damage to an engine caused thereby. In Limoli, the boat's circulating pump may be required to pull liquid from the reservoir which may result in inlet pressures below those when the boat is in the water. Moreover, the pressure relief valve makes the system undesirable as the liquid may spill and operator may get wet during operation.

Thus, while these devices provide means of flushing the engine of a boat, none of these devices adequately control the pressure of liquid delivered to a boat's coolant circulation system. These devices all rely upon a pressurized liquid source to force liquid through the boat engine or, in the case of Limoli, draw the liquid into the pump at pressures below that of normal operation and incorporate an awkward pressure relief valve in order to prevent engine damage due to overpressure. None of these systems adequately control the pressure delivered to the inlet of the cooling pump or prevent damage due to insufficient pressure. Many of these the prior systems cannot be permanently installed and can only be used to supply liquid to the cooling system when the boat is out of the water.

To properly operate a marine engine and to prevent damage it is necessary that the pressure at the inlet of the cooling water circulating pump be adequately controlled. Preferably, the pressure will approximate that of the boat when in the water. It is also desirable to avoid reliance on suction seals at the seawater intake, which may leak and cause severe engine damage. Hence, what is needed is a simple engine flushing device that is capable of self-adjusting to control fluid pressure at the inlet of the cooling pump.

SUMMARY OF THE INVENTION

A system and method for delivering liquid to the cooling water intake of an inboard motorboat in accordance with the present invention precisely controls pressure at the inlet of the cooling pump and allows the operator to safely run the engine for service, maintenance or demonstration. The system and method utilize a boat's coolant pump to circulate fluids through the boat engine at design flow rates and pressures. The invention includes a reservoir having an inlet and an outlet. The inlet is in liquid communication with a liquid supply through a flow control valve that controls liquid flow into the reservoir. The outlet is in liquid communication with the cooling pump of an inboard motorboat. An adjustable float senses the liquid level in the reservoir and is in communication with the flow control valve. The float sends a signal to the flow control valve to control the flow of liquid into the reservoir and thereby control the level of liquid in the reservoir. The desired liquid level in the reservoir may be adjusted by changing the position of the float. By controlling the liquid level, the method and system control the liquid pressure at inlet of the cooling pump. For example, liquid level can be maintained at an elevation approximating that of the waterline of the boat to deliver liquid to the circulating pump at a pressure approximately equal to that of the boat when in the water.

An object of the present invention is to provide a simple marine engine flushing system and method that safely and quickly flushes all coolant propulsion systems of inboard motorboats. The method and system further allow an individual to safely run a motorboat engine when the boat is out of the water, for example, while the boat is in storage or on dry dock.

A further object of the invention is to provide a method and system that may be permanently or temporarily installed.

A further object of this invention is to provide a method and system that avoids reliance on pressure relief valves.

A further object of this invention is to provide a system and method of supplying cooling liquid to an engine that can be used both when the boat is in the water and out of the water.

A further object of this invention is to eliminate the danger of damaging a boat engine by excessive or insufficient liquid pressure and flow during engine flushing by delivering cooling water to a boat's coolant pump at a precisely controlled pressure, for example, at a pressure approximating that of the boat when in the liquid.

A further objective is to provide a system that is easily and inexpensively manufactured.

Other aspects of the invention are disclosed infra.

DETAILED DESCRIPTION OF THE INVENTION

Figure 1:
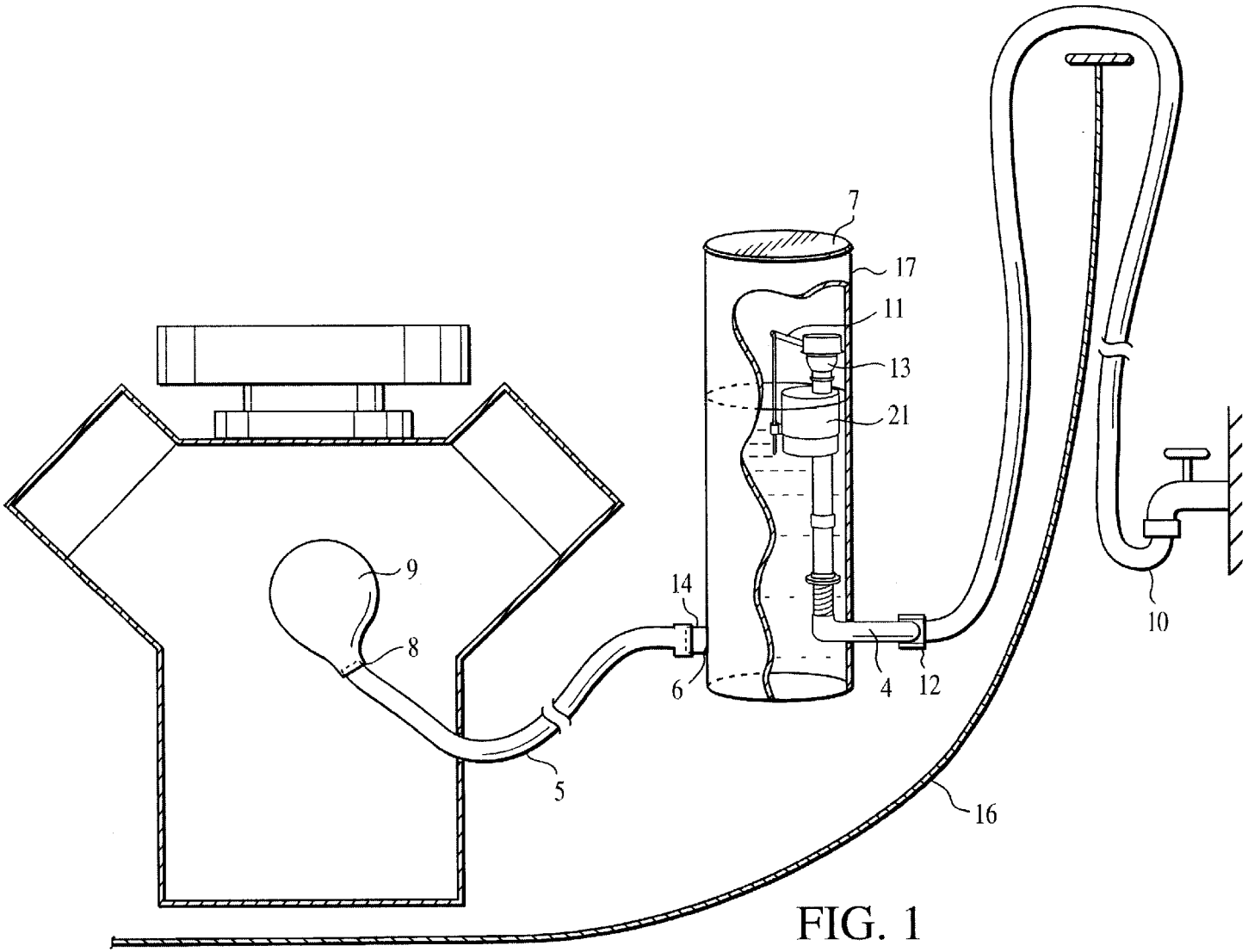
FIG. 1 Illustrates the device connected to engine of an inboard motorboat in accordance with one embodiment of the present invention.

FIG. 1 depicts the preferred embodiment of the present invention. As shown in FIG. 1, a liquid source 10, such as a garden hose, is in liquid communication with a reservoir 17. Reservoir 17 has an inlet 4, an outlet 6, and a cover 7. Preferably, cover 7 of reservoir 17 is adapted to provide a liquid tight seal with the reservoir 17 to prevent spillage of the liquid. Liquid is supplied from liquid source 10 to reservoir 17 through a valve 13 at the inlet 4 of reservoir 17. Valve 13 controls flow into reservoir 17. Within reservoir 17 is a float 21 for sensing the level of the liquid in reservoir 17. Float 21 is in mechanical communication with valve 13 by linkage 11. Reservoir 17 is in liquid communication with inlet 8 of cooling pump 9. Such liquid communication is provided by conduit 5. Preferably, conduit 5 is a clear reinforced hose that allows an individual to observe and confirm proper liquid circulation through the engine.

In operation, the boat's engine is initially off and reservoir 17 is empty. Float 21 is, therefore, below the desired liquid level. There is no flow through the outlet 6 of reservoir 17 to inlet 8 of cooling pump 9 because the boat's engine is stopped. Float 21 mechanically communicates with valve 13 by linkage 11 to open and allow liquid flow into reservoir 17. Because the liquid flow into reservoir 17 exceeds the liquid flow through outlet 6 of reservoir 17 to inlet 8 of cooling pump 9, the liquid level rises. As the liquid level rises, float 21 rises with it. As float 21 rises, it mechanically communicates with valve 13 by linkage 1 1 to reduce liquid flow into reservoir 17. When the liquid level reaches that desired, float 21 communicates with valve 13 by linkage 11 to stop the flow of liquid into reservoir 17. When the boat's engine is started, liquid flows from the outlet 6 of reservoir 17 through conduit 5 to inlet 8 of the cooling pump 9, causing liquid level to drop. As the liquid level drops below that desired, float 21 drops and mechanically communicates with valve 13 by linkage 11 to increase liquid flow to maintain the desired liquid level in reservoir 17.

Liquid is thereby delivered to inlet 8 of the cooling pump 9 at a controlled pressure that can be varied by adjusting the position of float 21 within reservoir 17 or changing the elevation of the reservoir 17 relative to the inlet 8 of cooling pump 9. Preferably, the liquid level is adjusted so that the pressure at inlet 8 of cooling pump 9 approximates that of the inlet pressure when the boat is afloat. Cooling pump 9 delivers liquid to the engine allowing the engine to be operated either for testing, demonstration, or flushing.

One of skill in the art will recognize that suitable floats for sensing liquid level in mechanical communication with a valve are widely available in the form of float valves. For example, float valves such as those available through Kerick Valve, Inc. may be used. Alternatively, float valves such as those used in common household toilets can be used. Both float valves include a means for sensing liquid level in mechanical communication with a flow control means.

This use of the boat engine's own cooling pump in connection with reservoir 17 effectively prevents excessive or insufficient liquid pressure within the engine by allowing the boat's own cooling pump to control the amount of liquid and the pressure under which the liquid is pumped within the engine. Thus, the engine's cooling pump operates to circulate liquids in the engine rather than allowing an external source to push the liquid in or require that the circulating pump pull the liquids into the system. Pressure within the system is controlled, thereby eliminating the danger of damage to the engine.

The entire system is liquid tight to prevent leakage of liquid out of the system. Thus, the connecting means between (a) liquid source 10 and reservoir 17, reservoir 17 and conduit 5, and (c) conduit 5 and inlet 8 of cooling pump 9 must be liquid tight. Such liquid tight connections may be accomplished by, for example, sealed male and female garden hose inlets and outlets. In the preferred embodiment, a sealed female garden hose inlet 12 connects the liquid source to reservoir 17, a sealed male garden hose outlet 14 connects reservoir 17 to conduit 5, and the conduit 5 is connected to inlet 8 of cooling pump 9 by means of hose clamps, with or without suitable adaptors that are well known in the art.

The system may be temporarily installed, inside or outside of a boat's hull 16, or permanently installed to provide a simple and effective means of flushing the cooling system of an inboard motorboat.

Figure 2:
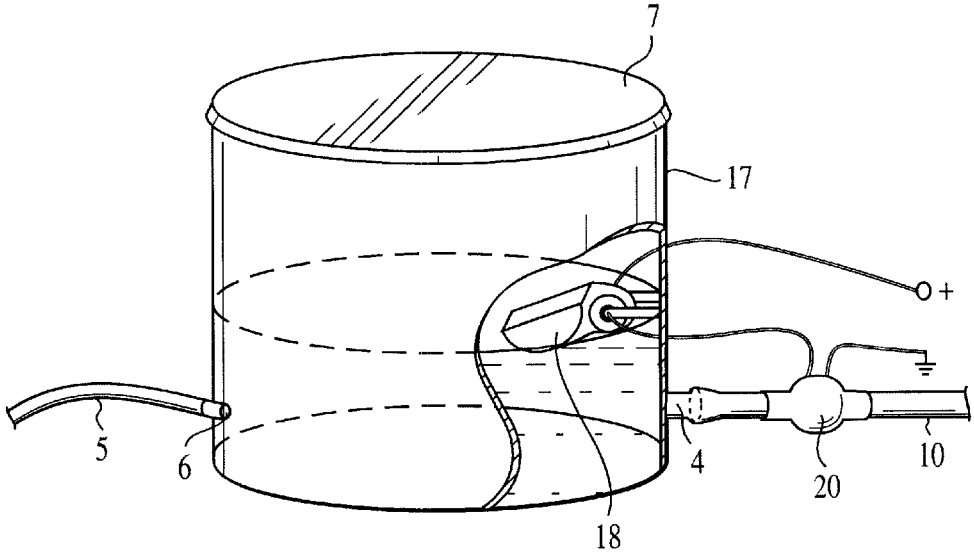
FIG. 2 Illustrates a second embodiment of the invention in which the liquid level sensing float is an electric float switch and the flow control valve is an electrically controlled valve.

FIG. 2 shows an alternative embodiment in which an electric float switch 18 is used to sense the liquid level in reservoir 17. Electric float switch 18 is in electrical communication with an electrically operated valve 20 that controls liquid flow into the reservoir 17. Electrically operated valve 20 may be either a solenoid type valve, having either an open or closed position, or may be of a control type which can vary amount of liquid passing by varying the valve opening. Where solenoid type valves are used, one of skill in the art will recognize that the volume of reservoir 17 must be sufficient to prevent short-cycling or rapid on-off fluctuations of the electrically operated valve. The appropriate volume can be readily determined by those of skill in the art based upon such known variables such as the flow rate of the cooling pump.

Figure 3:
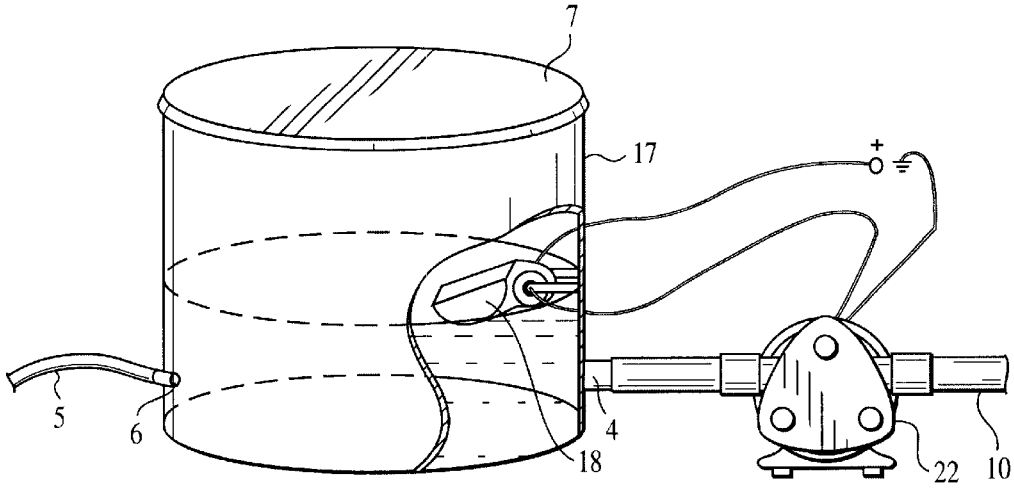
FIG. 3 Illustrates another embodiment of the invention in which the liquid level sensing float is an electric float switch and the flow control valve is an electrically controlled pump.

FIG. 3 shows another embodiment in which the liquid level sensing means is electric float switch 18 and the flow control means is an electrically controlled pump 22. Electrically controlled pump 22 may be either a constant speed or variable speed pump. One of skill in the art will recognize that where a constant speed pump is used, reservoir 17 must be of adequate volume to prevent short-cycling of the pump and can readily determine the appropriate volume.

Although a preferred embodiment of the invention has been described using specific terms, such description is for illustrative purposes only, and it is to be understood that changes and variations may be made without departing from the spirit or scope of the following claims.

I claim:

1. A system for delivering liquid to the cooling pump of an inboard motor boat comprising:

a) a liquid supply;

b) a reservoir having an inlet and an outlet in liquid communication with said cooling pump;

c) a flow control means for controlling the liquid flow from said liquid supply to said inlet of said reservoir;

d) a liquid level sensing means in communication with said flow control means such that the liquid level in said reservoir is controlled.

2. The system of claim 1 in which the flow control means is a mechanical valve in mechanical communication with the liquid level sensing means.

3. The system of claim 1 in which the flow control means is an electrically operated valve in electrical communication with the liquid level sensing means.

4. The system of claim 1 in which the flow control means is an electrically operated pump in electrical communication with the liquid level sensing means.

5. A method of supplying liquid to the cooling pump of an inboard motor boat comprising the steps of:

a) providing a liquid supply b) providing a reservoir having an inlet and an outlet, c) sensing the level of said liquid in said reservoir and generating a signal in response to said level, d) controlling the flow of liquid from said supply through said inlet of said reservoir, in response to said signal e) delivering said liquid to said cooling pump.

6. An apparatus for delivering liquid to the cooling pump of a boat engine comprising:

a) a liquid supply;

b) a reservoir having an inlet in fluid communication with the liquid supply and an outlet in fluid communication with said cooling pump;

c) a valve between said liquid supply and the inlet of the reservoir;

a float switch in communication with the valve.

7. A method of delivering a liquid to the cooling pump of a boat having a motor comprising the steps of:

a) providing a liquid supply;

b) providing a reservoir in fluid communication with the liquid supply and the cooling pump;

c) determining the liquid level in the reservoir;

d) generating a signal in response to the liquid level;

e) controlling the flow of liquid from the liquid supply to the reservoir in response to the signal.

* * * * *